US012606880B2

(12) United States Patent
Hirashima et al.

(10) Patent No.: US 12,606,880 B2
(45) Date of Patent: Apr. 21, 2026

(54) HIGH STRENGTH STEEL SHEET, HIGH STRENGTH MEMBER, AND METHODS FOR MANUFACTURING THE SAME

(71) Applicant: JFE Steel Corporation, Tokyo (JP)

(72) Inventors: Takuya Hirashima, Tokyo (JP); Yu Hashimoto, Tokyo (JP); Shinjiro Kaneko, Tokyo (JP); Yoshihiko Ono, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 808 days.

(21) Appl. No.: 17/629,857

(22) PCT Filed: Jul. 29, 2020

(86) PCT No.: PCT/JP2020/029049
§ 371 (c)(1),
(2) Date: Jan. 25, 2022

(87) PCT Pub. No.: WO2021/020438
PCT Pub. Date: Feb. 4, 2021

(65) Prior Publication Data

US 2022/0275469 A1 Sep. 1, 2022

(30) Foreign Application Priority Data

Jul. 31, 2019 (JP) ..... 2019-140372

(51) Int. Cl.

| | |
|---|---|
| ***C21D 9/46*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C23C 2/02*** | (2006.01) |
| ***C23C 2/28*** | (2006.01) |

(52) U.S. Cl.
CPC ..... *C21D 9/46* (2013.01); *C21D 8/0226* (2013.01); *C21D 8/0236* (2013.01); *C21D 8/0263* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C23C 2/0224* (2022.08); *C23C 2/28* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
CPC ..... C21D 9/46; C21D 8/0226; C21D 8/0236; C21D 8/0263; C21D 8/0273; C21D 2211/005; C22C 38/02; C22C 38/04; C22C 38/12; C22C 38/14; C22C 38/28; C22C 38/48; C22C 38/50; C22C 38/26; C22C 38/58; C22C 38/38
See application file for complete search history.

(56) References Cited

U.S. PATENT DOCUMENTS

| | | | | |
|---|---|---|---|---|
| 2015/0017472 | A1* | 1/2015 | Kimura | C22C 38/06 148/533 |
| 2015/0027594 | A1 | 1/2015 | Kawamura et al. | |
| 2017/0211164 | A1 | 7/2017 | Kimura et al. | |
| 2018/0171459 | A1 | 6/2018 | Drillet et al. | |
| 2019/0177810 | A1 | 6/2019 | Kondo et al. | |
| 2020/0299797 | A1 | 9/2020 | Kohsaka et al. | |

FOREIGN PATENT DOCUMENTS

| | | | |
|---|---|---|---|
| CN | 107429355 | A | 12/2017 |
| CN | 109642288 | A | 4/2019 |
| EP | 2757171 | A1 | 7/2014 |
| EP | 2762580 | A1 | 8/2014 |
| EP | 2762581 | A1 | 8/2014 |
| EP | 2816129 | A1 | 12/2014 |
| EP | 3255167 | A1 | 12/2017 |
| EP | 3508600 | A1 | 7/2019 |

(Continued)

OTHER PUBLICATIONS

Fanjun Ma, Guanchua Wen, Ping Tang, Guodong Xu, Feng Mei, Wanlin Wang, Effect of Cooling Rate on the Precipitation Behavior of Carbonitride in Microalloyed Steel Slab, 2011, Metallurgical and Materials Transactions, vol. 42B, pp. 81-86 (Year: 2011).*
Extended European Search Report for European Application No. 20 848 649.8, dated Apr. 12, 2022, 12 pages.
Chinese Office Action with Search Report for Chinese Application No. 202080055514.0, dated Apr. 15, 2022, 11 pages.
International Search Report and Written Opinion for International Application No. PCT/JP2020/029049, dated Oct. 20, 2020, 5 pages.
Chinese Office Action for Chinese Application No. 202080055514.0, dated Sep. 27, 2022, with Concise Statement of Relevance of Office Action, 7 pages.
European Communication pursuant to Article 94(3) for European Application No. 20 848 649.8, dated May 9, 2023, 4 pages.

*Primary Examiner* — Christina A Johnson
(74) *Attorney, Agent, or Firm* — Buchanan Ingersoll & Rooney PC

(57) ABSTRACT

The high strength steel sheet of the present invention has a specific chemical composition, and contains, in terms of area fraction relative to an entire steel microstructure, 30% or more and 100% or less ferrite, 0% or more and 70% or less martensite, and less than 20% in total of pearlite, bainite and retained austenite, a total content of Nb and Ti contained in a precipitate having a particle size of smaller than 20 nm is 25 mass ppm or more and 220 mass ppm or less, and the difference between the maximum value and the minimum value of the total content of Nb and Ti contained in the precipitate having a particle size of smaller than 20 nm, in the longitudinal direction of the steel sheet, is smaller than 20 mass ppm.

13 Claims, No Drawings

(56) References Cited

FOREIGN PATENT DOCUMENTS

| | | | | |
|---|---|---|---|---|
| JP | 2003193188 | A | * | 7/2003 |
| JP | 2004197119 | A | | 7/2004 |
| JP | 2005226081 | A | | 8/2005 |
| JP | 2011236483 | A | * | 11/2011 |
| JP | 2014047395 | A | | 3/2014 |
| JP | 2018016873 | A | | 2/2018 |
| WO | 2013073136 | A1 | | 5/2013 |
| WO | 2013114850 | A1 | | 8/2013 |
| WO | 2013121953 | A1 | | 8/2013 |
| WO | 2016198940 | A2 | | 12/2016 |
| WO | 2017169869 | A1 | | 10/2017 |

* cited by examiner

HIGH STRENGTH STEEL SHEET, HIGH STRENGTH MEMBER, AND METHODS FOR MANUFACTURING THE SAME

CROSS REFERENCE TO RELATED APPLICATIONS

This is the U.S. National Phase application of PCT/JP2020/029049, filed Jul. 29, 2020 which claims priority to Japanese Patent Application No. 2019-140372, filed Jul. 31, 2019, the disclosures of these applications being incorporated herein by reference in their entireties for all purposes.

FIELD OF THE INVENTION

The present invention relates to a high strength steel sheet and a high strength member used for automotive parts and so forth, and methods for manufacturing the same. In more detail, the present invention relates to a high strength steel sheet and a high strength member having high yield ratio and excellent material uniformity, and methods for manufacturing the same.

BACKGROUND OF THE INVENTION

In recent years, efforts have been directed to reducing emission gas such as $CO_2$ from the viewpoint of global environmental protection. Automotive industry has been taking measures of reducing volume of emission gas, by reducing automotive body weight thus improving fuel efficiency. One technique for reducing automotive body weight is exemplified by thinning of steel sheet used for automobile, through enhancement of strength. Steel sheet has however been known to degrade ductility as the strength improves, raising a need for a steel sheet well balanced between high strength and ductility. Moreover, the steel sheet whose mechanical property varies in the longitudinal direction (rolling direction) will degrade reproducibility of shape fixation, thus degrading reproducibility of the amount of springback, and making it difficult to keep shape of parts. There is therefore a need for steel sheet that is free of variation in mechanical property in the longitudinal direction of the steel sheet, and excels in material uniformity.

In response to such need, for example, Patent Literature 1 proposes a high strength steel sheet that contains, in mass %, C: 0.05 to 0.3%, Si: 0.01 to 3%, and Mn: 0.5 to 3%, with a volume fraction of ferrite of 10 to 50%, a volume fraction of martensite of 50 to 90%, a volume fraction of total of ferrite and martensite of 97% or larger, and the steel sheet having a small variation in strength in the longitudinal direction of the steel sheet, as a result of controlling a difference of coiling temperature between a front end part and a center part of the steel sheet to 0° C. or larger and 50° C. or smaller, and controlling a difference of coiling temperature between a rear end part and the center part of the steel sheet to 50° C. or larger and 200° C. or smaller.

Patent Literature 2 proposes a hot rolled steel sheet having a chemical composition that contains, in mass %, C: 0.03 to 0.2%, Mn: 0.6 to 2.0%, and Al: 0.02 to 0.15%, with a volume fraction of ferrite of 90% or larger, and the steel sheet having a small variation in strength in the longitudinal direction of the steel sheet, as a result of controlling cooling after coiling.

Patent Literature

Patent Literature 1: JP 2018-16873 A
Patent Literature 2: JP 2004-197119 A

SUMMARY OF THE INVENTION

According to the technique disclosed in Patent Literature 1, excellent material uniformity is attained by a ferrite-martensite microstructure, and by controlling the coiling temperature so as to reduce microstructural difference in the longitudinal direction of the steel sheet. There was, however, no control over variation in precipitate in the longitudinal direction of the steel sheet, leaving a problem of variation in yield strength unsolved.

According to the technique disclosed in Patent Literature 2, variation in strength in the longitudinal direction of the steel sheet is reduced by employing ferrite as a dominant phase, and by controlling the composition and cooling before coiling. There is, however, no addition of precipitation elements such as Nb or Ti, so that the aforementioned reduction of variation in strength is conceptionally different from aspects of the present invention that rely upon control of variation in precipitate in the longitudinal direction of the steel sheet to which the precipitation elements are added.

It is therefore an object according to aspects of the present invention to provide a high strength steel sheet and a high strength member, as well as methods for manufacturing the same, all aimed at achieving high yield ratio and excellent material uniformity, by properly adjusting the chemical composition in the presence of added precipitation element such as Nb and Ti that can affect precipitation hardening to achieve high yield ratio, by creating a ferrite-martensite microstructure, by controlling the total content of Nb and Ti contained in a precipitate having a particle size in the longitudinal direction of the steel sheet of smaller than 20 nm (also referred to as micro-precipitate, hereinafter), and by controlling variation in the amount of micro-precipitate in the longitudinal direction of the steel sheet.

The present inventors conducted extensive studies aiming at solving the issue mentioned above. The present inventors consequently found that it is necessary, for higher strength and higher yield ratio, to control the total content of Nb and Ti contained in the precipitate having a particle size of smaller than 20 nm to 25 mass ppm or more and 220 mass ppm or less of the steel sheet, and it is necessary, for lower variation in mechanical properties in the longitudinal direction of the steel sheet, to control difference between the maximum value and the minimum value of the total content of Nb and Ti contained in the precipitate having a particle size of smaller than 20 nm, in the longitudinal direction of the steel sheet, to smaller than 20 mass ppm.

As described above, the present inventors found, after our thorough investigations aimed at solving the aforementioned problems, that a steel sheet having a specific chemical composition, and having a steel microstructure mainly composed of ferrite and martensite, is obtainable as a high strength steel sheet having high yield ratio and excellent material uniformity, by controlling the total content of Nb and Ti contained in the micro-precipitate, and by controlling variation in the total content of Nb and Ti contained in the micro-precipitate in the longitudinal direction of the steel sheet (may simply be referred to as variation in the amount of micro-precipitate, hereinafter). Summary of aspects of the present invention is as follows.

[1] A high strength steel sheet having a chemical composition in mass % containing:

C: 0.06% or more and 0.14% or less,
Si: 0.1% or more and 1.5% or less,
Mn: 1.4% or more and 2.2% or less,
P: 0.05% or less,
S: 0.0050% or less, Al: 0.01% or more and 0.20% or less, N: 0.10% or less, Nb: 0.015% or more and 0.060% or less, and Ti: 0.001% or more and 0.030% or less, contents of S, N and Ti satisfying Formula (1) below, a balance being Fe and an inevitable impurity, including, in terms of area fraction relative to an entire steel microstructure, 30% or more and 100% or less ferrite, 0% or more and 70% or less martensite, and less than 20% in total of pearlite, bainite and retained austenite, a total content of Nb and Ti contained in a precipitate having a particle size of smaller than 20 nm being 25 mass ppm or more and 220 mass ppm or less, and a difference between a maximum value and a minimum value of the total content of Nb and Ti contained in the precipitate having a particle size of smaller than 20 nm, in a longitudinal direction of the steel sheet, being smaller than 20 mass ppm, $$[\%\ Ti]-(48/14)[\%\ N]-(48/32)[\%\ S]\leq 0, \qquad \text{Formula (1):}$$

in Formula (1), [% Ti] represents content (mass %) of component element Ti, [% N] represents content (mass %) of component element N, and [% S] represents content (mass %) of component element S.

[2] The high strength steel sheet according to [1], wherein the chemical composition further contains, in mass %, one of, or two or more of Cr: 0.01% or more and 0.15% or less, Mo: 0.01% or more and less than 0.10%, and V: 0.001% or more and 0.065% or less.

[3] The high strength steel sheet according to [1] or [2], wherein the chemical composition further contains, in mass %, B: 0.0001% or more and less than 0.002%.

[4] The high strength steel sheet according to any one of [1] to [3], wherein the chemical composition further contains, in mass %, one of or two of Cu: 0.001% or more and 0.2% or less, and Ni: 0.001% or more and 0.1% or less.

[5] The high strength steel sheet according to any one of [1] to [4], having a plating layer on a surface of the steel sheet.

[6] A high strength member including the high strength steel sheet according to any one of [1] to [5] subjected to at least either forming or welding.

[7] A method for manufacturing a high strength steel sheet, including: a hot rolling process in which a steel slab having the chemical composition according to any one of [1] to [4] is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to a temperature range of 500° C. or higher and 650° C. or lower at an average cooling rate of 10° C./sec or faster, and then coiled in the temperature range; and an annealing process in which the hot rolled steel sheet obtained in the hot rolling process is heated up to an annealing temperature which is $A_{C1}$ transformation temperature or higher and ($A_{C3}$ transformation temperature+20° C.) or lower, held at the annealing temperature for a hold time t (second) that satisfies Formula (3) below, and then cooled:

$$\log\{[\%\ Nb]\times([\%\ C]+12/14[\%\ N])\}\leq 0.75\times(2.4-6700/T) \qquad \text{Formula (2):}$$

In Formula (2), T represents heating temperature (° C.) of the steel slab, [% Nb] represents content (mass %) of component element Nb, [% C] represents content (mass %) of component element C, and [% N] represents content (mass %) of component element N.

$$1500\leq(AT+273)\times\log t<3000 \qquad \text{Formula (3):}$$

In Formula (3), AT represents annealing temperature (° C.), and t represents hold time (second) at the annealing temperature.

[8] A method for manufacturing a high strength steel sheet, including: a hot rolling process in which a steel slab having the chemical composition according to any one of [1] to [4] is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to a temperature range of 500° C. or higher and 650° C. or lower at an average cooling rate of 10° C./sec or faster, and then coiled in the temperature range;

a cold rolling process in which the hot rolled steel sheet obtained in the hot rolling process is cold-rolled; and an annealing process in which the cold rolled steel sheet obtained in the cold rolling process is heated up to an annealing temperature which is $A_{C1}$ transformation temperature or higher and ($A_{C3}$ transformation temperature+20° C.) or lower, held at the annealing temperature for a hold time t (second) that satisfies Formula (3) below, and then cooled:

$$\log\{[\%\ Nb]\times([\%\ C]+12/14[\%\ N])\}\leq 0.75\times(2.4-6700/T) \qquad \text{Formula (2):}$$

In Formula (2), T represents heating temperature (° C.) of the steel slab, [% Nb] represents content (mass %) of component element Nb, [% C] represents content (mass %) of component element C, and [% N] represents content (mass %) of component element N.

$$1500\leq(AT+273)\times\log t<3000 \qquad \text{Formula (3):}$$

In Formula (3), AT represents annealing temperature (° C.), and t represents hold time (second) at the annealing temperature.

[9] The method for manufacturing a high strength steel sheet according to [7] or [8], further including a plating process for providing plating, following the annealing process.

[10] A method for manufacturing a high strength member, including subjecting the high strength steel sheet manufactured by the method for manufacturing a high strength steel sheet according to any one of [7] to [9], to at least either forming or welding.

Aspects of the present invention control the steel microstructure and control variation in the amount of micro-precipitate in the longitudinal direction of the steel sheet, by adjusting the chemical composition and the manufacturing method. The high strength steel sheet according to aspects of the present invention has therefore high yield ratio and excellent material uniformity.

The high strength steel sheet according to aspects of the present invention, when applied for example to automotive structural member, can make automobile steel sheet having both high strength and material uniformity. That is, aspects of the present invention can keep the parts in good shape, and can enhance performance of the automotive body.

DETAILED DESCRIPTION OF EMBODIMENTS OF THE INVENTION

Hereafter, the embodiments of the present invention will be described. Here, the present invention is not limited to the embodiments described below.

First, a chemical composition of the high strength steel sheet (may occasionally be referred to as "steel sheet according to aspects of the present invention", hereinafter) will be explained. In the description below regarding the chemical composition of the steel sheet, "%" used as a unit of content of each component "mass %". Note that high strength in the context of the present invention means a tensile strength of 590 MPa or larger.

Also note that the steel sheet according to aspects of the present invention basically targeted at a steel sheet obtained by at least heating a steel slab in a heating furnace, hot-rolling each slab, and then coiling it. The steel sheet according to aspects of the present invention has high material uniformity in the longitudinal direction (rolling direction) of the steel sheet. That is, the steel sheet excels in material uniformity, with respect to each steel sheet (coil).

C: 0.06% or More and 0.14% or Less

C is an element for improving hardenability, and is necessary to obtain a predetermined area fraction of martensite, and micro-precipitate. C is also necessary from the viewpoint of improving strength of martensite, to achieve TS≥590 MPa. C content less than 0.06% will fail in achieving a predetermined strength. Thus, the C content is set to 0.06% or more. The C content is preferably 0.07% or more. On the other hand, the C content more than 0.14% will increase area fraction of martensite, leading to excessive strength. Moreover, the amount of production of carbide increases, and this fails in controlling variation in the amount of micro-precipitate in the longitudinal direction of the steel sheet, and degrades the material uniformity. Thus, the C content is set to 0.14% or less. The C content is preferably 0.13% or less.

Si: 0.1% or More and 1.5% or Less

Si is a strengthening element that causes solid solution strengthening. To obtain this effect, Si content is set to 0.1% or more. The Si content is preferably 0.2% or more, and more preferably 0.3% or more. Meanwhile, Si demonstrates a suppressive effect on production of cementite, so that excessive Si content will suppress cementite from being produced, and unprecipitated C forms carbide with Nb or Ti and becomes coarsened, whereby the material uniformity degrades. Thus, the Si content is set to 1.5% or less. The Si content is preferably 1.4% or less.

Mn: 1.4% or More and 2.2% or Less

Mn is included in order to improve hardenability of steel, and to achieve a predetermined area fraction of martensite. Mn content of less than 1.4% makes it difficult to obtain a predetermined amount of micro-precipitate, since pearlite or bainite is produced during cooling. Thus, the Mn content is set to 1.4% or more. The Mn content is preferably 1.5% or more. On the other hand, excessive Mn content will increase the area fraction of martensite, leading to excessive strength. Moreover, formation of MnS results in the total amount of N and S being less than amount of Ti, and this fails in suppressing variation in the amount of micro-precipitate in the longitudinal direction of the steel sheet, and degrades the material uniformity. Thus, the Mn content is set to 2.2% or less. The Mn content is preferably 2.1% or less.

P: 0.05% or Less

P is an element that can strengthen the steel, but the excessive content thereof will result in segregation at grain boundary, thus degrading the workability. P content is therefore controlled to 0.05% or less, in order to achieve a minimum necessary level of workability when applied to automobile. The P content is preferably 0.03% or less, and more preferably 0.01% or less. Although the lower limit of the P content is not specifically limited, an industrially feasible lower limit at present is approximately 0.003%.

S: 0.0050% or Less

S degrades the workability, through formation of MnS, TiS, Ti(C,S) and so forth. S content therefore needs to be controlled to 0.0050% or less, in order to achieve a minimum necessary level of workability when applied to automobile. The S content is preferably 0.0020% or less, more preferably 0.0010% or less, and still more preferably 0.0005% or less. Although the lower limit of the S content is not specifically limited, an industrially feasible lower limit at present is approximately 0.0002%.

Al: 0.01% or More and 0.20% or Less

Al is added in order to cause thorough deoxidation and to reduce the coarse inclusion in the steel. The effect emerges at an Al content of 0.01% or more. The Al content is preferably 0.02% or more. On the other hand, with the Al content more than 0.20%, the carbide produced during coiling after hot rolling will become less likely to solute during the annealing process, so that coarse inclusion or carbide is produced, and the yield ratio degrades. Thus, the Al content is set to 0.20% or less. The Al content is preferably 0.17% or less, and more preferably 0.15% or less.

N: 0.10% or Less

N is an element that forms, in the steel, nitride-based or carbonitride-based coarse inclusion such as TiN, (Nb, Ti) (C, N), or AlN. With the N content more than 0.10%, variation in the amount of micro-precipitate in the longitudinal direction of the steel sheet cannot be suppressed, thus degrading the material uniformity. Hence, the N content needs to be controlled to 0.10% or less. The N content is preferably 0.07% or less, and more preferably 0.05% or less. Although the lower limit of the N content is not specifically limited, an industrially feasible lower limit at present is approximately 0.0006%.

Nb: 0.015% or More and 0.060% or Less

Nb contributes to precipitation hardening through production of micro-precipitate, and increasing yield ratio. In order to obtain such effect, Nb content is necessarily 0.015% or more. The Nb content is preferably 0.020% or more, and more preferably 0.025% or more. On the other hand, large content of Nb increases variation in the amount of micro-precipitate in the longitudinal direction of the steel sheet, and thus degrades the material uniformity. Thus, the Nb content is set to 0.060% or less. The Nb content is preferably 0.055% or less, and more preferably 0.050% or less.

Ti: 0.001% or More and 0.030% or Less

Ti contributes to precipitation hardening through production of micro-precipitate, and increasing yield ratio. In order to obtain such effect, Ti content is necessarily 0.001% or more. The Ti content is preferably 0.002% or more, and more preferably 0.003% or more. On the other hand, large content of Ti increases variation in the amount of micro-precipitate in the longitudinal direction of the steel sheet, and thus degrades the material uniformity. Thus, the Ti content is set to 0.030% or less. The Ti content is preferably 0.020% or less, more preferably 0.017% or less, and still more preferably 0.015% or less.

The contents of S, N and Ti satisfy Formula (1) below:

$$[\%\ Ti]-(48/14)[\%\ N]-(48/32)[\%\ S]\leq 0, \qquad \text{Formula (1):}$$

in Formula (1), [% Ti] represents content (mass %) of component element Ti, [% N] represents content (mass %) of component element N, and [% S] represents content (mass %) of component element S.

With the amount of Ti controlled to be not larger than the total amount of N and S in atomic ratio, Ti-containing carbide that is possibly produced during coiling may be suppressed from being produced, thus making it possible to suppress variation in the amount of micro-precipitate in the longitudinal direction of the steel sheet. In order to obtain such effect, "[% Ti]−(48/14)[% N]−(48/32)[% S]" is 0 (0.0000) or smaller, which is preferably smaller than 0 (0.0000), and more preferably −0.001 or smaller. The lower limit of "[% Ti]−(48/14)[% N]−(48/32)[% S]", although not specifically limited, is preferably −0.01 or larger, in order to suppress production of inclusion that is possibly ascribed to excessive N content and S content.

The steel sheet according to aspects of the present invention contains the aforementioned components, and the balance other than the aforementioned components has a chemical composition that contains Fe (iron) and an inevitable impurity. Now, the steel sheet according to aspects of the present invention preferably contains the aforementioned components, and the balance preferably has a chemical composition that is composed of Fe and an inevitable impurity. The steel sheet according to aspects of the present invention can also contain the components below, as freely selectable components. Note that any of the freely selectable components below, if the content thereof is less than the lower limit value, is understood to be contained as the inevitable impurity.

Any One of, or Two or More of Cr: 0.01% or More and 0.15% or Less; Mo: 0.01% or More and Less than 0.10%; and V: 0.001% or More and 0.065% or Less Cr, Mo, and V may be contained, for the purpose of improving hardenability of steel. In order to obtain such effect, both of Cr content and Mo content are preferably 0.01% or more, and more preferably 0.02% or more. The V content is preferably 0.001% or more, and more preferably 0.002% or more. Note however that any of these elements, when contained excessively, can degrade the material uniformity by producing carbides. Therefore, the Cr content is preferably 0.15% or less, and more preferably 0.12% or less. The Mo content is preferably less than 0.10%, and more preferably 0.08% or less. The V content is preferably 0.065% or less, and more preferably 0.05% or less.

B: 0.0001% or More and Less than 0.002%

B is an element that improves the hardenability of the steel, and when contained, demonstrates an effect of producing martensite with a predetermined area fraction, even if the Mn content is low. To obtain such an effect of B, the B content is preferably 0.0001% or more. The B content is more preferably 0.00015% or more. On the other hand, B whose content is more than 0.002% will form nitride with N, and Ti whose amount becomes abundant will easily form carbide during coiling, thus degrading the material uniformity. Thus, the B content is preferably less than 0.002%. The B content is more preferably less than 0.001%, and more preferably 0.0008% or less.

One of, or Two of Cu: 0.001% or More and 0.2% or Less, and Ni: 0.001% or More and 0.1% or Less Cu and Ni demonstrate effects of improving corrosion resistance in use environment of automobiles, and of suppressing hydrogen penetration into the steel sheet, through coverage of the surface of the steel sheet with corrosion products. In order to attain a minimum necessary level of corrosion resistance for automotive use, both of the Cu and Ni contents are preferably 0.001% or more, and more preferably 0.002% or more. In order to suppress surface defect from occurring due to excessive Cu and Ni contents, the Cu content is however preferably 0.2% or less, and more preferably 0.15% or less. The Ni content is preferably 0.1% or less, and more preferably 0.07% or less.

Note that the steel sheet according to aspects of the present invention may contain Ta, W, Sn, Sb, Ca, Mg, Zr or REM as the other element, without damaging the effect according to aspects of the present invention, where a content of each of these elements of 0.1% or less is acceptable.

Next, the steel microstructure of the steel sheet according to aspects of the present invention will be explained. The steel sheet according to aspects of the present invention contains, in terms of area fraction relative to an entire steel microstructure, 30% or more and 100% or less ferrite, 0% or more and 70% or less martensite, and less than 20% in total of pearlite, bainite and retained austenite. In addition, a total content of Nb and Ti contained in a precipitate having a particle size of smaller than 20 nm is 25 mass ppm or more and 220 mass ppm or less, and the difference between the maximum value and the minimum value of the total content of Nb and Ti contained in the precipitate having a particle size of smaller than 20 nm, in the longitudinal direction of the steel sheet, is smaller than 20 mass ppm.

Area Fraction of Ferrite is 30% or More and 100% or Less

C hardly forms solid solution with ferrite, and migrates so as to be expelled from ferrite, but when cooled, C forms carbide before being expelled. The area fraction of ferrite is important in terms of precipitate producing site, and when controlled to 30% or more, allows the micro-precipitate to be sufficiently produced, whereby high yield ratio is achieved and the strength is improved by a synergistic effect of structural hardening due to martensite and precipitation hardening due to the micro-precipitate. Hence, the area fraction of ferrite is specified to 30% or larger. The area fraction of ferrite is preferably 35% or larger, more preferably 40% or larger, and even more preferably 50% or larger. The upper limit of the area fraction of ferrite is not specifically limited, and may even be 100% so far as a sufficient level of strength may be achieved by precipitation hardening with the aid of micro-precipitate. Since, however, large area fraction of ferrite tends to increase variation in the amount of micro-precipitate in the longitudinal direction of the steel sheet, the area fraction of ferrite is preferably 95% or smaller, and more preferably 90% or smaller.

Area Fraction of Martensite is 0% or More and 70% or Less

With the area fraction of martensite more than 70% relative to the entire microstructure, the strength will become excessive. The area fraction of martensite, relative to the entire steel microstructure is therefore specified to be 70% or smaller. The area fraction of martensite is preferably 65% or smaller, and more preferably 60% or smaller. The lower limit of the area fraction of martensite is not specifically limited, and may even be 0% so far as a sufficient level of strength may be achieved by precipitation hardening with the aid of micro-precipitate. The area fraction of martensite is preferably 5% or larger and more preferably 10% or larger, from the viewpoint of further suppressing variation in the amount of micro-precipitate in the longitudinal direction of the steel sheet as previously suggested.

The balance other than ferrite and martensite includes retained austenite, bainite and pearlite, and is acceptable if the area fraction thereof accounts for less than 20%. The area fraction of the balance is preferably 10% or less, and more preferably 7% or less. The area fraction of the balance may even be 0%. In accordance with aspects of the present invention, ferrite is a microstructure that is produced as a result of transformation from austenite at relatively high temperatures, and is composed of crystal grains having BCC lattice. Martensite refers to a hard microstructure that is produced from austenite at low temperatures (at or below martensite transformation temperature). Bainite refers to a hard microstructure that is produced from austenite at relatively low temperatures (at or above martensite transformation temperature), in which fine carbide is dispersed in needle-like or plate-like ferrite. Pearlite refers to a microstructure that is produced from austenite, and is composed of lamellar ferrite and cementite. Retained austenite is produced as a result of lowering of the martensite transformation temperature in austenite down to room temperature or below by concentration of C or other element in the austenite.

Values of the area fraction of the individual structures in the steel microstructure employed herein are those obtained by measurement according to methods described later in Examples.

Total Content of Nb and Ti Contained in Precipitate Having Particle Size of Smaller than 20 nm is 25 mass ppm or More and 220 mass ppm or Less The total content of Nb and Ti contained in the precipitate having a particle size of smaller than 20 nm may be easily measured by a method described later in Examples. The total content (mass ppm) in the context of the present invention means a mass ratio of Nb and Ti contained in the precipitate having a particle size of smaller than 20 nm, relative to the steel sheet. Strengthening with the aid of the micro-precipitate is necessary to increase the strength and yield ratio. In order to obtain such effect, the total content of Nb and Ti contained in the precipitate having a particle size of smaller than 20 nm is necessarily controlled to 25 mass ppm or more. The total content is preferably 27 mass ppm or more, and more preferably 30 mass ppm or more. Meanwhile, with the total content more than 220 mass ppm, not only the strength becomes excessive, but also the amount of production of carbide increases, and this fails in controlling variation in the amount of micro-precipitate in the longitudinal direction of the steel sheet, and degrades the material uniformity. The total content of Nb and Ti contained in the precipitate having a particle size of smaller than 20 nm is specified to 220 mass ppm or less. The total content is preferably 215 mass ppm or less, and more preferably 210 mass ppm or less.

Difference between Maximum Value and Minimum Value of Total Content of Nb and Ti Contained in Precipitate Having Particle Size of Smaller than 20 nm, in Longitudinal Direction of Steel Sheet, is Smaller than 20 mass ppm Since the amount of micro-precipitate directly affects the strength, excellent material uniformity is obtainable by suppressing variation in the amount of micro-precipitate in the longitudinal direction of the steel sheet. In order to obtain such effect, difference between the maximum value and the minimum value of the total content of Nb and Ti contained in the precipitate having a particle size of smaller than 20 nm, in the longitudinal direction of the steel sheet, is specified to smaller than 20 mass ppm. The total content is preferably 18 mass ppm or less, and more preferably 15 mass ppm or less. The lower limit of the total content, although not specifically limited, may even be 0 mass ppm. The "difference between the maximum value and the minimum value of the total content of Nb and Ti contained in the precipitate having a particle size of smaller than 20 nm, in the longitudinal direction of the steel sheet is specified to smaller than 20 mass ppm" in the context of the present invention means that the difference between the maximum value and the minimum value of the total content is smaller than 20 mass ppm, over the entire length of the longitudinal direction (rolling direction) of the steel sheet, with respect to every steel sheet (coil). The difference may be measured by a method described later in Examples.

The steel sheet according to aspects of the present invention may have a plating layer on the surface of the steel sheet. The plating layer is typically an electrogalvanized layer, hot-dip galvanized layer, or hot-dip galvannealed layer, without limitation in particular.

Next, properties of the high strength steel sheet according to aspects of the present invention will be explained.

The steel sheet according to aspects of the present invention has a tensile strength of 590 MPa or larger, when measured by a method described later in Examples. The tensile strength, although not specifically limited, is preferably smaller than 980 MPa, from the viewpoint of easy balancing with other properties.

The steel sheet according to aspects of the present invention has high yield ratio. More specifically, the yield ratio calculated from tensile strength and yield strength measured by a method described later in Examples is 0.70 or larger. The yield ratio is preferably 0.72 or larger, and more preferably 0.75 or larger. The upper limit of the yield ratio, although not specifically limited, is preferably 0.9 or smaller, from the viewpoint of easy balancing with other properties.

The steel sheet according to aspects of the present invention excels in the material uniformity. More specifically, difference between the maximum value and the minimum value of the yield ratio (AYR) in the longitudinal direction of the steel sheet, calculated from tensile strength and yield strength measured by a method described later in Examples, is 0.05 or smaller. The difference is preferably 0.03 or less, and more preferably 0.02 or less.

Next, a method for manufacturing the high strength steel sheet according to aspects of the present invention will be explained.

The method for manufacturing the high strength steel sheet according to aspects of the present invention has a hot rolling process, an optional cold rolling process, and an annealing process. Now, the temperature when heating or cooling the slab (steel raw material), steel sheet or the like described below, is understood to be surface temperature of the slab (the steel raw material), steel sheet or the like, unless otherwise specifically noted.

<Hot Rolling Process>

A hot rolling process is a process in which a steel slab having the chemical composition described above is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to a temperature range of 500° C. or higher and 650° C. or lower at an average cooling rate of 10° C./sec or faster, and then coiled in the temperature range.

$$\log\{[\%\ Nb]\times([\%\ C]+12/14[\%\ N])\}\leq 0.75\times(2.4-6700/T) \quad \text{Formula (2):}$$

In Formula (2), T represents heating temperature (° C.) of the steel slab, [% Nb] represents content (mass %) of component element Nb, [% C] represents content (mass %)

of component element C, and [% N] represents content (mass %) of component element N.

Formula (2) above is satisfied during slab heating. If Formula (2) above is not satisfied, Nb-containing carbonitride is excessively produced during slab heating, and this makes amount of Ti larger than the total amount of N and S during coiling, and degrades the material uniformity. Hence, the slab heating temperature is determined to satisfy the aforementioned Formula (2). Heating temperature T (° C.) of steel slab preferably satisfies Formula (2A) below, and more preferably satisfies Formula (2B) below.

$$\log\{[\%\ Nb]\times([\%\ C]+12/14[\%\ N])\}\leq 0.77\times(2.4-6700/T) \quad \text{Formula (2A):}$$

$$\log\{[\%\ Nb]\times([\%\ C]+12/14[\%\ N])\}\leq 0.80\times(2.4-6700/T) \quad \text{Formula (2B):}$$

The upper limit of the slab heating temperature is not particularly limited, but is preferably 1500° C. or less. Soaking time is specified to 1.0 hour or longer. A soaking time of shorter than 1.0 hour is insufficient for Nb-and Ti-containing carbonitrides to fully solute, so that the Nb-containing carbonitride will excessively remain during slab heating. Hence, the amount of Ti will become larger than total amount of N and S during coiling, thereby degrading the material uniformity. The soaking time is therefore specified to 1.0 hour or longer, and preferably 1.5 hours or longer. The upper limit of the soaking time, although not specifically limited, is usually 3 hours or shorter. Heating rate when heating a cast steel slab to the slab heating temperature, although not specifically limited, is preferably controlled to 5 to 15° C./min.

Average Cooling Rate from Slab Heating Temperature down to Rolling Start Temperature is 2° C./sec or Faster If the average cooling rate from the slab heating temperature down to the rolling start temperature is slower than 2° C./sec, the Nb-containing carbonitride is excessively produced, so that the amount of Ti will become larger than total amount of N and S during coiling, thereby degrading the material uniformity. The average cooling rate from the slab heating temperature down to the rolling start temperature is therefore specified to 2° C./sec or faster. The average cooling rate is preferably 2.5° C./sec or faster, and more preferably 3° C./sec or faster. The upper limit of the average cooling rate, although not specifically limited from the viewpoint of improving the material uniformity, is preferably specified to be 1000° C./sec or slower, from the viewpoint of energy saving of cooling facility.

Finisher Delivery Temperature is 850° C. or Higher

If the finisher delivery temperature is lower than 850° C., cooling needs longer time, during which Nb- or Ti-containing carbonitride can be produced. This consequently reduces the amount of N, fails in suppressing production of Ti-containing precipitate that is possibly produced during coiling, increases variation in the amount of micro-precipitate in the longitudinal direction of the steel sheet, and degrades the material uniformity. The finisher delivery temperature is therefore specified to 850° C. or higher. The finisher delivery temperature is preferably 860° C. or higher. Meanwhile, the upper limit of the finisher delivery temperature, although not specifically limited, is preferably 950° C. or lower and more preferably 920° C. or lower, in order to avoid difficulty of cooling down to the coiling temperature.

Coiling Temperature is 500° C. or Higher and 650° C. or Lower

If the coiling temperature is higher than 650° C., a large amount of precipitate is produced as a result of coiling, so that variation in the amount of micro-precipitate in the longitudinal direction of the steel sheet cannot be suppressed, thereby degrading the material uniformity. The lower limit of the coiling temperature is therefore specified to 650° C. or lower. The coiling temperature is preferably 640° C. or lower. On the other hand, if the coiling temperature is lower than 500° C., the amount of precipitate to be produced reduces, and this fails in achieving precipitation hardening, and the yield ratio declines. The coiling temperature is therefore specified to 500° C. or higher. The coiling temperature is preferably 520° C. or higher.

Average Cooling Rate from Finisher Delivery Temperature down to Coiling Temperature is 10° C./sec or Faster If the average cooling rate from the finisher delivery temperature down to the coiling temperature is slow, the Nb- or Ti-containing carbonitride is excessively produced before coiling, this consequently decreases the amount of N, fails in suppressing production of Ti-containing precipitate that is produced as a result of coiling, increases variation in the amount of micro-precipitate in the longitudinal direction of the steel sheet, and degrades the material uniformity. The average cooling rate from the finisher delivery temperature down to the coiling temperature is therefore specified to 10° C./sec or faster. The average cooling rate is preferably 20° C./sec or faster, and more preferably 30° C./sec or faster. The upper limit of the average cooling rate, although not specifically limited from the viewpoint of improving the material uniformity, is preferably specified to be 1000° C./sec or slower, from the viewpoint of energy saving of cooling facility.

The coiled hot rolled steel sheet may be pickled. Pickling conditions are not specifically limited.

<Cold Rolling Process>

The cold rolling process is a process for cold-rolling the hot rolled steel sheet obtained in the hot rolling process. Reduction ratio of the cold rolling, although not specifically limited, is preferably specified to 20% or larger, from the viewpoint of improving flatness of the surface, and making the microstructure further uniform. The upper limit of the reduction ratio, although not specifically limited, is preferably 95% or smaller, in consideration of cold rolling load. Note that the cold rolling process is not essential, and is omissible if the steel microstructure and mechanical properties satisfy aspects of the present invention.

<Annealing Process>

An annealing process is a process in which the cold rolled steel sheet or the hot rolled steel sheet is heated up to an annealing temperature which is $A_{C1}$ transformation temperature or higher and ($A_{C3}$ transformation temperature+20° C.) or lower, held at the annealing temperature for a hold time t (second) that satisfies Formula (3) below, and then cooled.

$$1500\leq(AT+273)\times\log t<3000 \quad \text{Formula (3):}$$

In Formula (3), AT represents annealing temperature (° C.), and t represents hold time (second) at the annealing temperature.

Annealing Temperature is $A_{C1}$ Transformation Temperature or Higher and ($A_{C3}$ Transformation Temperature+20° C.) or Lower If the annealing temperature is lower than $A_{C1}$ transformation temperature, micro-precipitate that can be produced during annealing becomes less likely to be produced due to cementite production, making it difficult to obtain a necessary amount of micro-precipitate for proper strength to be achieved. The annealing temperature is therefore specified to be $A_{C1}$ transformation temperature or higher. The annealing temperature is preferably ($A_{C1}$ transformation temperature+10° C.) or higher, and more preferably ($A_{C1}$ transformation temperature+20° C.) or higher. On the other hand, if the annealing temperature is higher than ($A_{C3}$ transformation temperature+20° C.), the precipitate is coarsened to reduce the amount of micro-precipitate, so that the precipitation hardening becomes ineffective, and the yield ratio declines. The annealing temperature is therefore specified to be ($A_{C3}$ transformation temperature+20° C.) or lower. The annealing temperature is preferably ($A_{C3}$ transformation temperature+10° C.) or lower, and more preferably $A_{C3}$ transformation temperature or lower.

Note that the $A_{C1}$ transformation temperature and $A_{C3}$ transformation temperature are calculated using Formulae below. Also note that (% element symbol) represents the content (mass %) of each element in the following formulae.

$$A_{C1}(^\circ\text{ C.})=723+22[\%\text{ Si}]-18[\%\text{ Mn}]+17[\%\text{ Cr}]+4.5[\%\text{ Mo}]+16[\%\text{ V}]$$

$$A_{C3}(^\circ\text{ C.})=910-203\sqrt{[\%\text{ C}]}+45[\%\text{ Si}]-30[\%\text{ Mn}]-20[\%\text{ Cu}]-15[\%\text{ Ni}]+11[\%\text{ Cr}]+32[\%\text{ Mo}]+104[\%\text{ V}]+400\ [\%\text{ Ti}]+460\ [\%\text{Al}]$$

Hold time t (second) at annealing temperature AT (° C.) satisfies Formula (3).

A short hold time at the annealing temperature makes reverse transformation to austenite less likely to occur, so that the micro-precipitate that can be produced during annealing becomes less likely to be produced due to production of cementite, making it difficult to obtain a necessary amount of micro-precipitate for proper strength to be achieved. On the other hand, a long hold time at the annealing temperature coarsens the precipitate to reduce the amount of micro-precipitate, so that the precipitation hardening becomes ineffective, and the yield ratio declines. The hold time t (second) at the annealing temperature AT (° C.) therefore satisfies Formula (3). The hold time t (second) at the annealing temperature AT (° C.) preferably satisfies Formula (3A) below, and more preferably satisfies Formula (3B) below.

$$1600\leq(AT+273)\times\log t<2900 \qquad \text{Formula (3A):}$$

$$1700\leq(AT+273)\times\log t<2800 \qquad \text{Formula (3B):}$$

Cooling rate during cooling after holding at the annealing temperature is not specifically limited.

Note that the hot rolled steel sheet after the hot rolling process may be subjected to heat treatment for softening the microstructure, and the annealing process may be followed by temper rolling for shape control.

The annealing process may be followed by plating process for plating, so long as properties of the steel sheet will not change. The plating is, for example, a process of subjecting the surface of the steel sheet to electrogalvanized plating, hot-dip galvanizing, or hot-dip galvannealing. When subjecting the surface of the steel sheet to hot-dip galvanizing, a hot-dip galvanized layer is preferably formed on the surface of the steel sheet, typically by dipping the steel sheet obtained as described previously into a galvanizing bath at 440° C. or higher and 500° C. or lower. The plating is preferably followed by control of the coating weight, typically by gas wiping. The steel sheet after hot-dip galvanizing may be subjected to alloying. The hot-dip galvanized layer, when alloyed, is preferably alloyed in the temperature range from 450° C. or higher and 580° C. or lower, by holding it for 1 second or longer and 60 seconds or shorter. When subjecting the surface of the steel sheet to electrogalvanization, process conditions may conform to those of any of conventional methods without limitation in particular.

According to the aforementioned manufacturing method of this embodiment, it now becomes possible, through control of hot-rolling conditions and temperature and time of annealing, to control microstructure proportion, the amount of micro-precipitate, and variation in the amount of micro-precipitate in the longitudinal direction of the steel sheet, and to obtain the high strength steel sheet that has high yield ratio and excellent material uniformity.

Next, the high strength member and the method for manufacturing the same according to aspects of the present invention will be explained.

The high strength member according to aspects of the present invention is the high strength steel sheet according to aspects of the present invention subjected to at least either forming or welding. Moreover, the method for manufacturing the high strength member includes subjecting the high strength steel sheet manufactured by the method for manufacturing a high strength steel sheet according to aspects of this invention, to at least either forming or welding.

Since the high strength steel sheet according to aspects of the present invention is well balanced between high strength and material uniformity, the high strength member obtained with use of the high strength steel sheet according to aspects of the present invention can keep good shape of parts. Hence, the high strength member according to aspects of the present invention is suitably applicable, for example, to automotive structural member.

The forming may rely upon any of common forming methods such as press working, without limitation. The welding may rely upon any of common welding such as spot welding or arc welding, without limitation.

EXAMPLES

Example 1

Aspects of the present invention will now be specifically described with reference to Examples. Note that the scope of the present invention is not limited to the following Examples.

1. Manufacture of Steel Sheet for Evaluation

Each steel having a chemical composition listed in Table 1, and the balance that includes Fe and inevitable impurity was melted in a vacuum melting furnace, and bloomed to obtain a bloomed material of 27 mm thick. The bloomed material thus obtained was then hot-rolled to a thickness of 4.0 mm. Conditions of the hot rolling process are as summarized in Table 2. Next, a sample of each hot rolled steel sheet, intended to be further cold-rolled, was ground to reduce the thickness to 3.2 mm, and cold-rolled according to a reduction ratio listed in Table 2, to manufacture each cold rolled steel sheet. Next, each of the hot rolled steel sheet and the cold rolled steel sheet was annealed under conditions listed in Table 2, to manufacture each steel sheet. Sample No. 55 in Table 2 is a steel sheet whose surface was subjected, after annealing, to hot-dip galvanizing. Sample No. 56 in Table 2 is a steel sheet whose surface, after annealing, was subjected to hot-dip galvannealing. Sample No. 57 in Table 2 is a steel sheet whose surface, after annealing and subsequent cooling down to room temperature, was subjected to electrogalvanizing.

Note that the blank cells in Table 1 represent that elements were not intentionally added but were not always 0 mass %, occasionally allowing inevitable content.

Meanwhile, "–" in the cells of cold rolling in Table 2 represents that the steel sheet was not cold-rolled.

Again in Table 2, "1: Lower limit of slab heating temperature calculated from Formula (2)" represents values calculated by using the aforementioned Formula (2): $\log\{[\%\ Nb]\times([\%\ C]+12/14[\%\ N])\}\leq 0.75\times(2.4-6700/T)$.

In Formula (2), T represents heating temperature (° C.) of the steel slab, [% Nb] represents content (mass %) of component element Nb, [% C] represents content (mass %) of component element C, and [% N] represents content (mass %) of component element N.

TABLE 1

| Steel | Chemical composition (in mass %) | | | | | | | | | | | | | | | | $A_{c1}$ | $A_{c3}$ |
|---|---|---|---|---|---|---|---|---|---|---|---|---|---|---|---|---|---|---|
| type | C | Si | Mn | P | S | Al | N | Nb | Ti | Cr | Mo | V | B | Cu | Ni | *1 | (° C.) | (° C.) |
| A | 0.090 | 0.50 | 1.80 | 0.007 | 0.0008 | 0.05 | 0.0031 | 0.045 | 0.008 | | | | | | | −0.0038 | 702 | 842 |
| B | 0.062 | 0.48 | 1.84 | 0.007 | 0.0009 | 0.02 | 0.0022 | 0.045 | 0.005 | | | | | | | −0.0039 | 701 | 836 |
| C | 0.132 | 0.15 | 1.74 | 0.007 | 0.0008 | 0.05 | 0.0033 | 0.018 | 0.012 | | | | | | | −0.0005 | 695 | 815 |
| D | 0.088 | 1.47 | 2.00 | 0.007 | 0.0008 | 0.05 | 0.0021 | 0.045 | 0.008 | | | | | | | −0.0004 | 720 | 880 |
| E | 0.093 | 0.30 | 1.42 | 0.009 | 0.0007 | 0.04 | 0.0026 | 0.045 | 0.002 | | | | | | | −0.0080 | 705 | 838 |
| F | 0.110 | 0.45 | 2.18 | 0.040 | 0.0008 | 0.04 | 0.0029 | 0.035 | 0.005 | | | | | | | −0.0061 | 694 | 816 |
| G | 0.089 | 0.42 | 1.78 | 0.007 | 0.0008 | 0.03 | 0.0035 | 0.057 | 0.012 | | 0.03 | 0.008 | | | | −0.0012 | 701 | 833 |
| H | 0.092 | 1.10 | 1.81 | 0.006 | 0.0030 | 0.05 | 0.0023 | 0.045 | 0.008 | | | | | | | −0.0044 | 715 | 868 |
| I | 0.120 | 1.20 | 1.60 | 0.007 | 0.0009 | 0.06 | 0.0150 | 0.045 | 0.025 | 0.05 | | | | | | −0.0278 | 722 | 880 |
| J | 0.088 | 0.46 | 1.87 | 0.009 | 0.0006 | 0.06 | 0.0800 | 0.030 | 0.008 | | | | 0.0005 | 0.009 | | −0.2672 | 700 | 842 |
| K | 0.090 | 0.80 | 1.83 | 0.007 | 0.0008 | 0.18 | 0.0032 | 0.045 | 0.011 | | | | | | 0.006 | −0.0012 | 708 | 914 |
| L | 0.150 | 0.56 | 1.76 | 0.006 | 0.0008 | 0.05 | 0.0024 | 0.045 | 0.008 | | | | | | | −0.0014 | 704 | 828 |
| M | 0.053 | 0.48 | 1.88 | 0.007 | 0.0005 | 0.04 | 0.0023 | 0.045 | 0.008 | | | | | | | −0.0006 | 701 | 848 |
| N | 0.088 | 1.56 | 1.92 | 0.006 | 0.0009 | 0.05 | 0.0033 | 0.045 | 0.010 | | | | | | | −0.0027 | 724 | 886 |
| O | 0.091 | 0.46 | 2.40 | 0.007 | 0.0008 | 0.03 | 0.0025 | 0.045 | 0.008 | | | | | | | −0.0018 | 691 | 812 |
| P | 0.093 | 0.51 | 1.29 | 0.006 | 0.0008 | 0.05 | 0.0021 | 0.045 | 0.008 | | | | | | | −0.0004 | 712 | 857 |
| Q | 0.102 | 0.51 | 1.71 | 0.007 | 0.0008 | 0.25 | 0.0021 | 0.045 | 0.008 | | | | | | | −0.0004 | 704 | 933 |
| R | 0.095 | 0.51 | 1.76 | 0.007 | 0.0009 | 0.04 | 0.1500 | 0.045 | 0.008 | | | | | | | −0.5076 | 703 | 837 |
| S | 0.083 | 0.45 | 1.88 | 0.007 | 0.0008 | 0.04 | 0.0029 | 0.070 | 0.008 | | | | | | | −0.0031 | 700 | 835 |
| T | 0.090 | 0.48 | 1.88 | 0.007 | 0.0006 | 0.04 | 0.0025 | 0.045 | 0.035 | | | | | | | 0.0255 | 701 | 834 |
| U | 0.090 | 0.48 | 1.88 | 0.007 | 0.0020 | 0.04 | 0.0022 | 0.045 | 0.016 | | | | | | | 0.0055 | 701 | 834 |

*1: [% Ti] − (48/14) [% N] − (48/32) [% S]

TABLE 2

| | | Hot rolling | | | | | | | Cold | Annealing condition | | | |
|---|---|---|---|---|---|---|---|---|---|---|---|---|---|
| | | Slab | | Slab | | Finisher | | | | | | | |
| No. | Steel type | heating temperature ° C. | *1 | heating time Time (h) | *2 ° C./second | delivery temperature ° C. | Coiling temperature ° C. | *3 ° C./second | rolling Reduction ratio % | Annealing temperature ° C. | *4 Second | *5 | Remarks |
| 1 | A | 1250 | 1202 | 1.2 | 5 | 880 | 600 | 30 | 56 | 800 | 35 | 1657 | Invention Example |
| 2 | | 1300 | 1202 | 1.2 | 5 | 880 | 600 | 30 | 56 | 800 | 35 | 1657 | Invention Example |
| 3 | | 1250 | 1202 | 1.2 | 5 | 880 | 600 | 30 | 56 | 800 | 35 | 1657 | Invention Example |
| 4 | | 1250 | 1202 | 1.2 | 5 | 880 | 600 | 30 | 56 | 800 | 100 | 2146 | Invention Example |
| 5 | B | 1130 | 1157 | 1.2 | 5 | 880 | 600 | 30 | 56 | 800 | 80 | 2042 | Comparative Example |
| 6 | | 1200 | 1157 | 1.2 | 5 | 880 | 600 | 30 | 56 | 800 | 60 | 1908 | Invention Example |
| 7 | | 1250 | 1157 | 1.4 | 5 | 880 | 600 | 30 | 56 | 820 | 35 | 1688 | Invention Example |
| 8 | | 1300 | 1157 | 2.0 | 5 | 880 | 600 | 30 | 56 | 800 | 35 | 1657 | Invention Example |
| 9 | C | 1280 | 1235 | 0.4 | 5 | 880 | 600 | 30 | 56 | 810 | 35 | 1672 | Comparative Example |
| 10 | | 1280 | 1235 | 1.2 | 5 | 880 | 600 | 30 | 56 | 800 | 120 | 2231 | Invention Example |
| 11 | | 1280 | 1235 | 2.1 | 5 | 880 | 600 | 30 | 56 | 800 | 60 | 1908 | Invention Example |
| 12 | | 1280 | 1235 | 2.4 | 5 | 880 | 600 | 30 | 56 | 800 | 20 | 1396 | Comparative Example |
| 13 | D | 1250 | 1198 | 1.2 | 1 | 880 | 600 | 30 | 56 | 800 | 35 | 1657 | Comparative Example |
| 14 | | 1250 | 1198 | 1.4 | 2 | 860 | 600 | 30 | 56 | 780 | 35 | 1626 | Invention Example |
| 15 | | 1250 | 1198 | 1.2 | 5 | 900 | 600 | 30 | 56 | 800 | 35 | 1657 | Invention Example |

TABLE 2-continued

| | | Hot rolling | | | | | | | | | | | |
|---|---|---|---|---|---|---|---|---|---|---|---|---|---|
| | | Slab | | Slab | | Finisher | | | Cold | Annealing condition | | | |
| No. | Steel type | heating temperature ° C. | *1 | heating time Time (h) | *2 ° C./second | delivery temperature ° C. | Coiling temperature ° C. | *3 ° C./second | rolling Reduction ratio % | Annealing temperature ° C. | *4 Second | *5 | Remarks |
| 16 | | 1250 | 1198 | 1.6 | 10 | 880 | 600 | 30 | 56 | 800 | 35 | 1657 | Invention Example |
| 17 | E | 1250 | 1206 | 1.2 | 5 | 830 | 600 | 30 | 56 | 820 | 35 | 1688 | Comparative Example |
| 18 | | 1250 | 1206 | 1.2 | 5 | 850 | 550 | 30 | 56 | 800 | 40 | 1719 | Invention Example |
| 19 | | 1250 | 1206 | 1.2 | 5 | 880 | 600 | 30 | 56 | 800 | 35 | 1657 | Invention Example |
| 20 | | 1250 | 1206 | 1.2 | 5 | 920 | 630 | 30 | 56 | 800 | 35 | 1657 | Invention Example |
| 21 | F | 1250 | 1195 | 1.2 | 5 | 880 | 480 | 30 | 56 | 800 | 35 | 1657 | Comparative Example |
| 22 | | 1250 | 1195 | 1.2 | 5 | 880 | 550 | 30 | 56 | 790 | 35 | 1641 | Invention Example |
| 23 | | 1250 | 1195 | 1.2 | 5 | 880 | 600 | 25 | 56 | 800 | 45 | 1774 | Invention Example |
| 24 | | 1250 | 1195 | 1.2 | 5 | 880 | 670 | 30 | 56 | 800 | 35 | 1657 | Comparative Example |
| 25 | G | 1250 | 1171 | 1.2 | 5 | 880 | 600 | 8 | 56 | 800 | 35 | 1657 | Comparative Example |
| 26 | | 1250 | 1171 | 1.2 | 5 | 880 | 600 | 15 | 56 | 800 | 35 | 1657 | Invention Example |
| 27 | | 1250 | 1171 | 1.2 | 5 | 880 | 550 | 35 | 56 | 810 | 35 | 1672 | Invention Example |
| 28 | | 1250 | 1171 | 1.2 | 5 | 880 | 600 | 800 | 60 | 800 | 35 | 1657 | Invention Example |
| 29 | H | 1250 | 1204 | 1.2 | 5 | 880 | 600 | 30 | — | 800 | 50 | 1823 | Invention Example |
| 30 | | 1250 | 1204 | 1.2 | 5 | 880 | 600 | 60 | — | 800 | 35 | 1657 | Invention Example |
| 31 | | 1250 | 1204 | 1.2 | 5 | 880 | 600 | 30 | 30 | 760 | 35 | 1595 | Invention Example |
| 32 | | 1250 | 1204 | 1.2 | 5 | 880 | 600 | 20 | 70 | 850 | 35 | 1734 | Invention Example |
| 33 | I | 1280 | 1238 | 1.2 | 5 | 880 | 600 | 30 | 56 | 700 | 120 | 2023 | Comparative Example |
| 34 | | 1280 | 1238 | 1.2 | 5 | 880 | 600 | 30 | 40 | 750 | 80 | 1947 | Invention Example |
| 35 | | 1280 | 1238 | 1.2 | 5 | 880 | 600 | 30 | 50 | 850 | 52 | 1927 | Invention Example |
| 36 | | 1280 | 1238 | 1.2 | 5 | 880 | 600 | 30 | 56 | 910 | 77 | 2232 | Comparative Example |
| 37 | J | 1250 | 1150 | 1.2 | 5 | 880 | 600 | 30 | 56 | 800 | 20 | 1396 | Comparative Example |
| 38 | | 1250 | 1150 | 1.2 | 5 | 880 | 600 | 30 | 56 | 820 | 40 | 1751 | Invention Example |
| 39 | | 1250 | 1150 | 1.2 | 5 | 880 | 600 | 30 | 56 | 800 | 35 | 1657 | Invention Example |
| 40 | | 1250 | 1150 | 1.2 | 5 | 880 | 600 | 30 | 56 | 840 | 600 | 3092 | Comparative Example |
| 41 | K | 1200 | 1202 | 1.2 | 5 | 880 | 600 | 30 | 56 | 800 | 35 | 1657 | Comparative Example |
| 42 | | 1250 | 1202 | 1.2 | 5 | 880 | 600 | 30 | 56 | 800 | 35 | 1657 | Invention Example |
| 43 | | 1300 | 1202 | 1.2 | 5 | 880 | 600 | 30 | 56 | 800 | 35 | 1657 | Invention Example |
| 44 | | 1250 | 1202 | 1.2 | 5 | 880 | 600 | 30 | 56 | 730 | 30 | 1482 | Comparative Example |
| 45 | L | 1320 | 1267 | 1.2 | 5 | 880 | 600 | 30 | 56 | 800 | 35 | 1657 | Comparative Example |
| 46 | M | 1250 | 1140 | 1.2 | 5 | 880 | 600 | 30 | 56 | 800 | 35 | 1657 | Comparative Example |
| 47 | N | 1250 | 1200 | 1.2 | 5 | 880 | 600 | 30 | 56 | 800 | 35 | 1657 | Comparative Example |
| 48 | O | 1250 | 1203 | 1.2 | 5 | 880 | 600 | 30 | 56 | 800 | 35 | 1657 | Comparative Example |
| 49 | P | 1250 | 1205 | 1.2 | 5 | 880 | 600 | 30 | 56 | 800 | 40 | 1719 | Comparative Example |

TABLE 2-continued

| | | Hot rolling | | | | | | | | | | | |
|---|---|---|---|---|---|---|---|---|---|---|---|---|---|
| | | Slab | | Slab | | Finisher | | | Cold | Annealing condition | | | |
| No. | Steel type | heating temperature ° C. | *1 | heating time Time (h) | *2 ° C./second | delivery temperature ° C. | Coiling temperature ° C. | *3 ° C./second | rolling Reduction ratio % | Annealing temperature ° C. | *4 Second | *5 | Remarks |
| 50 | Q | 1260 | 1217 | 1.2 | 5 | 880 | 600 | 30 | 56 | 800 | 35 | 1657 | Comparative Example |
| 51 | R | 1270 | 1221 | 1.2 | 5 | 880 | 600 | 30 | 56 | 800 | 50 | 1823 | Comparative Example |
| 52 | S | 1300 | 1249 | 1.2 | 5 | 880 | 600 | 30 | 56 | 800 | 35 | 1657 | Comparative Example |
| 53 | T | 1250 | 1201 | 1.2 | 5 | 880 | 600 | 30 | 56 | 800 | 35 | 1657 | Comparative Example |
| 54 | U | 1250 | 1201 | 1.2 | 5 | 880 | 600 | 30 | 56 | 820 | 35 | 1688 | Comparative Example |
| 55 | A | 1250 | 1202 | 1.2 | 5 | 880 | 600 | 40 | 56 | 800 | 40 | 1719 | Invention Example |
| 56 | | 1250 | 1202 | 1.0 | 4 | 880 | 600 | 30 | 56 | 800 | 35 | 1657 | Invention Example |
| 57 | | 1250 | 1202 | 1.4 | 5 | 880 | 550 | 50 | 56 | 800 | 35 | 1657 | Invention Example |

*1: Lower limit of the slab heating temperature calculated from formula (2)
*2: Average cooling rate from the slab heating temperature to the rolling start temperature
*3: Average cooling rate from the finisher delivery temperature to the coiling temperature
*4: Hold time (t) at the annealing temperature (AT)
*5: (AT + 273) × logt 2. Evaluation Methods Steel microstructures of the steel sheets obtained under various manufacturing conditions were analyzed to investigate the microstructure proportion, and were subjected to tensile test to evaluate tensile properties including tensile strength. Methods for the individual evaluations are as follows.

(Area Fractions of Ferrite and Martensite)

Test specimens were sampled from the steel sheets in the rolling direction, and the L cross-sections taken in the thickness direction and in parallel to the rolling direction were mirror polished. The cross-sections taken in the thickness direction were etched with nital solution to expose the microstructure, and then observed under a scanning electron microscope (SEM). The area fractions of ferrite and martensite were examined by the point counting method, according to which a 16×15 mesh with a 4.8 μm interval was overlaid on a 82 μm×57 μm area in actual length in a 1500× SEM image, and the number of mesh points that fall in the individual phases were counted. Each area fraction was determined by an average value of three area fraction values obtained from independent 1500× SEM images. Ferrite has a microstructure that is black, and martensite has a microstructure that is white. The area fraction of the balance, other than ferrite and martensite, was calculated by subtracting the total area fraction of ferrite and martensite, from 100%. In accordance with aspects of the present invention, the balance was considered to represent the total area fraction of pearlite, bainite, and retained austenite. The area fraction of the balance is given in the column titled "Others" in Table 3.

The area fractions were measured by using a test specimen sampled at the center both in the longitudinal direction (rolling direction) and in the width direction of the steel sheet.

(Total Content of Nb and Ti Contained in Precipitate having Particle Size of Smaller than 20 nm)

Five grams of each steel sheet was placed in a 10% acetylacetone-1% tetramethylammonium chloride-methanol solution for electrolytic extraction, and the solution was filtered through a filter having a pore size of 20 nm. The filtrate was dried up, to which nitric acid, perchloric acid and sulfuric acid were added, and the mixture was heated to dissolution until white mist of the sulfuric acid is produced. The dissolution liquid was allowed to cool, to which hydrochloric acid was added, followed by dilution with pure water. The diluted liquid was subjected to elemental analysis with use of an ICP emission spectrophotometric analyzer. Mass ratio (mass ppm) of the total content of Nb and Ti contained in the precipitate having a particle size of smaller than 20 nm, relative to the steel sheet, was calculated from the results of elemental analysis.

Samples were collected individually from a front end part, a center part, and a rear end part in the longitudinal direction (rolling direction) of the steel sheet, and analyzed by the aforementioned extraction residue method, to determine, for the individual parts, the total content (mass ppm) of Nb and Ti contained in the precipitate having a particle size of smaller than 20 nm. Difference between the maximum value and the minimum value out of the measured values at the three parts was determined. Note that the measurement of the front end part, the center part, and the rear end part in the longitudinal direction (rolling direction) of the steel sheet are conducted at the center in the width direction, respectively.

Note that the measurement at the front end part in the longitudinal direction of the steel sheet was conducted at a position 1 m from the front end towards the center part. On the other hand, the measurement at the rear end part in the longitudinal direction of the steel sheet was conducted at a position 1 m from the rear end towards the center part.

In accordance with aspects of the present invention, the "difference between the maximum value and the minimum value out of the total contents of Nb and Ti contained in the precipitate having a particle size of smaller than 20 nm, calculated after measurement at the front end part, the center part, and the rear end part in the longitudinal direction (rolling direction) of the steel sheet" was assumed as the "difference between the maximum value and the minimum value of the total content of Nb and Ti contained in the precipitate having a particle size of smaller than 20 nm, in the longitudinal direction of the steel sheet". The differences between the maximum value and the minimum value are summarized in Table 3.

The coiling temperature tends to become highest and the cooling rate after coiling tends to become slowest at the center part in the longitudinal direction of the steel sheet; meanwhile the coiling temperature tends to become lowest and the cooling rate after coiling tends to become fastest at the front end part and the rear end part in the longitudinal direction of the steel sheet. Hence, the Nb- and Ti-containing micro-precipitate tends to become scarcest at the center part in the longitudinal direction of the steel sheet, meanwhile tends to become most abundant at the front end part and the rear end part. Hence, the measured value obtained at the front end part or rear end part in the longitudinal direction of the steel sheet, whichever is larger, was assumed as the maximum value. Meanwhile, the measured value obtained at the center part in the longitudinal direction of the steel sheet was assumed as the minimum value. Hence in accordance with aspects of the present invention, the difference between the maximum value and the minimum value of the total content of Nb and Ti, in the longitudinal direction (rolling direction) of the steel sheet, is calculated as a difference between the maximum value and the minimum value out of the measured values obtained at three points, which are the front end part, the center part, and the rear end part in the longitudinal direction (rolling direction) of the steel sheet.

Meanwhile, in accordance with aspects of the present invention, the total content of Nb and Ti contained in the precipitate having a particle size of smaller than 20 nm, measured at the center part both in the longitudinal direction and in the width direction of the steel sheet, was specified as the total content of Nb and Ti contained in the precipitate having a particle size of smaller than 20 nm. The total contents are summarized in Table 3.

(Tensile Test)

JIS No. 5 specimens with a gauge length of 50 mm and a width of the section between gauge marks of 25 mm were sampled from the individual steel sheets in the direction vertical to the rolling direction, and subjected to tensile test at a tensile speed of 10 ram/min, in compliance with the requirements of JIS Z 2241 (2011). Tensile strength (denoted as TS in Table 3), and yield strength (denoted as YS in Table 3) were measured by the tensile test. The yield ratio (denoted as YR in Table 3) was calculated by dividing YS by TS. Note that the tensile strength (TS), the yield strength (YS), and the yield ratio (YR) summarized in Table 3 are values obtained by measuring each specimen sampled from the steel sheet at the center part both in the longitudinal direction (rolling direction) and in the width direction.

(Material Uniformity)

The aforementioned tensile test was conducted individually at the front end part, the center part, and the rear end part in the longitudinal direction of the steel sheet, and material uniformity was evaluated on the basis of difference (denoted as ΔYR in Table 3) between the maximum value and the minimum value out from the measured values of yield ratio (YR) at these three parts. Note that the measurements at the front end part, the center part, and the rear end part in the longitudinal direction of the steel sheet were individually conducted at the center part in the width direction. The measurement in accordance with aspects of the present invention at the front end part in the longitudinal direction of the steel sheet was conducted at a position 1 m from the front end towards the center part. On the other hand, the measurement in accordance with aspects of the present invention at the rear end part in the longitudinal direction of the steel sheet was conducted at a position 1 m from the rear end towards the center part.

3. Evaluation Results

Evaluation results are summarized in Table 3.

TABLE 3

| | | Microstructure | | | | | Mechanical property | | | | |
|---|---|---|---|---|---|---|---|---|---|---|---|
| | | | | | *1 | *2 | | | | | |
| No. | Steel type | α % | M % | Others % | Mass ppm | Mass ppm | YS MPa | TS MPa | YR | ΔYR | Remarks |
| 1 | A | 71 | 24 | 5 | 80 | 10 | 498 | 638 | 0.78 | 0.02 | Invention Example |
| 2 | | 73 | 26 | 1 | 80 | 8 | 503 | 645 | 0.78 | 0.01 | Invention Example |
| 3 | | 72 | 23 | 5 | 80 | 11 | 509 | 636 | 0.80 | 0.02 | Invention Example |
| 4 | | 72 | 27 | 1 | 75 | 10 | 492 | 645 | 0.76 | 0.02 | Invention Example |
| 5 | B | 75 | 20 | 5 | 65 | 25 | 466 | 602 | 0.77 | 0.07 | Comparative Example |
| 6 | | 78 | 20 | 2 | 65 | 17 | 454 | 602 | 0.75 | 0.05 | Invention Example |
| 7 | | 79 | 21 | 0 | 60 | 11 | 462 | 604 | 0.76 | 0.02 | Invention Example |
| 8 | | 75 | 18 | 7 | 65 | 7 | 471 | 601 | 0.78 | 0.00 | Invention Example |
| 9 | C | 59 | 39 | 2 | 90 | 25 | 545 | 724 | 0.75 | 0.07 | Comparative Example |
| 10 | | 58 | 40 | 2 | 85 | 9 | 545 | 722 | 0.75 | 0.02 | Invention Example |
| 11 | | 58 | 40 | 2 | 90 | 12 | 535 | 721 | 0.74 | 0.03 | Invention Example |
| 12 | | 60 | 40 | 0 | 10 | 10 | 478 | 725 | 0.66 | 0.02 | Comparative Example |
| 13 | D | 65 | 33 | 2 | 240 | 21 | 564 | 705 | 0.80 | 0.08 | Comparative Example |
| 14 | | 65 | 35 | 0 | 180 | 18 | 539 | 706 | 0.76 | 0.05 | Invention Example |
| 15 | | 62 | 36 | 2 | 80 | 10 | 552 | 699 | 0.79 | 0.02 | Invention Example |
| 16 | | 60 | 34 | 6 | 80 | 9 | 551 | 697 | 0.79 | 0.02 | Invention Example |
| 17 | E | 83 | 17 | 0 | 65 | 21 | 451 | 596 | 0.76 | 0.06 | Comparative Example |
| 18 | | 81 | 17 | 2 | 65 | 17 | 454 | 592 | 0.77 | 0.05 | Invention Example |
| 19 | | 82 | 14 | 4 | 75 | 10 | 453 | 593 | 0.76 | 0.02 | Invention Example |
| 20 | | 80 | 13 | 7 | 75 | 18 | 451 | 591 | 0.76 | 0.05 | Invention Example |
| 21 | F | 50 | 43 | 7 | 15 | 12 | 557 | 823 | 0.68 | 0.02 | Comparative Example |
| 22 | | 54 | 45 | 1 | 60 | 12 | 642 | 827 | 0.78 | 0.02 | Invention Example |
| 23 | | 54 | 46 | 0 | 80 | 13 | 653 | 826 | 0.79 | 0.03 | Invention Example |
| 24 | | 51 | 46 | 3 | 80 | 23 | 634 | 824 | 0.77 | 0.06 | Comparative Example |
| 25 | G | 75 | 24 | 1 | 280 | 35 | 498 | 630 | 0.79 | 0.11 | Comparative Example |

TABLE 3-continued

| | | Microstructure | | | | | Mechanical property | | | | |
|---|---|---|---|---|---|---|---|---|---|---|---|
| | | | | | *1 | *2 | | | | | |
| No. | Steel type | α % | M % | Others % | Mass ppm | Mass ppm | YS MPa | TS MPa | YR | ΔYR | Remarks |
| 26 | | 75 | 23 | 2 | 210 | 19 | 484 | 629 | 0.77 | 0.05 | Invention Example |
| 27 | | 75 | 23 | 2 | 160 | 13 | 499 | 630 | 0.79 | 0.03 | Invention Example |
| 28 | | 72 | 24 | 4 | 170 | 12 | 501 | 626 | 0.80 | 0.03 | Invention Example |
| 29 | H | 70 | 30 | 0 | 80 | 10 | 512 | 648 | 0.79 | 0.02 | Invention Example |
| 30 | | 68 | 31 | 1 | 80 | 11 | 520 | 650 | 0.80 | 0.02 | Invention Example |
| 31 | | 80 | 20 | 0 | 50 | 10 | 483 | 649 | 0.74 | 0.02 | Invention Example |
| 32 | | 35 | 60 | 5 | 105 | 13 | 580 | 748 | 0.78 | 0.03 | Invention Example |
| 33 | I | 97 | 3 | 0 | 20 | 12 | 407 | 595 | 0.68 | 0.03 | Comparative Example |
| 34 | | 91 | 8 | 1 | 125 | 13 | 424 | 601 | 0.71 | 0.03 | Invention Example |
| 35 | | 69 | 31 | 0 | 140 | 11 | 475 | 647 | 0.73 | 0.03 | Invention Example |
| 36 | | 28 | 60 | 12 | 20 | 12 | 487 | 745 | 0.65 | 0.03 | Comparative Example |
| 37 | J | 65 | 29 | 6 | 15 | 13 | 456 | 659 | 0.69 | 0.03 | Comparative Example |
| 38 | | 68 | 29 | 3 | 70 | 13 | 511 | 660 | 0.77 | 0.03 | Invention Example |
| 39 | | 68 | 32 | 0 | 80 | 12 | 517 | 663 | 0.78 | 0.03 | Invention Example |
| 40 | | 68 | 31 | 1 | 20 | 11 | 449 | 661 | 0.68 | 0.03 | Comparative Example |
| 41 | K | 67 | 31 | 2 | 75 | 23 | 504 | 650 | 0.78 | 0.07 | Comparative Example |
| 42 | | 67 | 29 | 4 | 75 | 10 | 487 | 646 | 0.75 | 0.02 | Invention Example |
| 43 | | 69 | 28 | 3 | 75 | 6 | 488 | 647 | 0.75 | 0.00 | Invention Example |
| 44 | | 89 | 11 | 0 | 10 | 10 | 411 | 621 | 0.66 | 0.02 | Comparative Example |
| 45 | L | 47 | 48 | 5 | 140 | 22 | 663 | 826 | 0.80 | 0.07 | Comparative Example |
| 46 | M | 79 | 19 | 2 | 80 | 10 | 460 | 576 | 0.80 | 0.02 | Comparative Example |
| 47 | N | 60 | 40 | 0 | 80 | 21 | 521 | 677 | 0.77 | 0.06 | Comparative Example |
| 48 | O | 37 | 59 | 4 | 80 | 21 | 656 | 853 | 0.77 | 0.07 | Comparative Example |
| 49 | P | 65 | 11 | 24 | 20 | 10 | 326 | 469 | 0.70 | 0.02 | Comparative Example |
| 50 | Q | 69 | 31 | 0 | 15 | 10 | 436 | 639 | 0.68 | 0.02 | Comparative Example |
| 51 | R | 70 | 29 | 1 | 80 | 22 | 498 | 639 | 0.78 | 0.07 | Comparative Example |
| 52 | S | 67 | 31 | 2 | 320 | 21 | 520 | 651 | 0.80 | 0.06 | Comparative Example |
| 53 | T | 61 | 36 | 3 | 320 | 28 | 521 | 668 | 0.78 | 0.08 | Comparative Example |
| 54 | U | 60 | 36 | 4 | 80 | 29 | 534 | 668 | 0.80 | 0.07 | Comparative Example |
| 55 | A | 69 | 26 | 5 | 80 | 11 | 506 | 638 | 0.79 | 0.02 | Invention Example |
| 56 | | 71 | 24 | 5 | 70 | 10 | 498 | 635 | 0.78 | 0.02 | Invention Example |
| 57 | | 71 | 24 | 5 | 100 | 13 | 513 | 647 | 0.79 | 0.03 | Invention Example |

α: Area fraction of ferrite,
M: Area fraction of martensite
Other: Total area fraction of perlite, bainite, and retained austenite
*1: Total content of Nb and Ti contained in precipitate having particle size of smaller than 20 nm
*2: Difference between maximum value and minimum value of total content of Nb and Ti contained in precipitate having particle size of smaller than 20 nm, in longitudinal direction of steel sheet In this embodiment, the steel sheets with a TS of 590 MPa or larger, a YR of 0.70 or larger, and a ΔYR of 0.05 or smaller were judged to be acceptable, and listed as inventive examples in Table 3. In contrast, the steel sheets that do not satisfy at least one of these requirements were judged to be rejected, and listed as comparative example in Table 3.

Example 2

No. 1 steel sheet of Example 1, listed in Table 3, was formed by pressing, to manufacture a member of this invention example. Further, No. 1 steel sheet of Example 1 listed in Table 3, and No. 2 steel sheet of Example 1 listed in Table 3 were welded by spot welding, to manufacture a member of this invention example. It was confirmed that, since the high strength steel sheet of this invention example is well balanced between high strength and material uniformity, the high strength member obtained with use of the high strength steel sheet of this invention example can keep good shape of parts, and that the steel sheet is suitably applicable to automotive structural member.

The invention claimed is:

1. A high strength steel sheet having a chemical composition in mass % containing:

C: 0.06% or more and 0.14% or less,
Si: 0.1% or more and 1.5% or less,
Mn: 1.4% or more and 2.2% or less,
P: 0.05% or less,
S: 0.0050% or less,
Al: 0.01% or more and 0.20% or less,
N: 0.10% or less,
Nb: 0.015% or more and 0.060% or less, and
Ti: 0.001% or more and 0.030% or less, optionally containing one or more of following (A) to (C);

(A) one of, or two or more of
Cr: 0.01% or more and 0.15% or less,
Mo: 0.01% or more and less than 0.10%, and
V: 0.001% or more and 0.065% or less,
(B) B: 0.0001% or more and less than 0.002%,
(C) one of or two of,
Cu: 0.001% or more and 0.2% or less, and
Ni: 0.001% or more and 0.1% or less, contents of S, N and Ti satisfying Formula (1) below, a balance being Fe and an inevitable impurity, comprising, in terms of area fraction relative to an entire steel microstructure, 30% or more and 100% or less ferrite, 0% or more and 70% or less martensite, and less than 20% in total of pearlite, bainite and retained austenite, a total content of Nb and Ti contained in a precipitate having a particle size of smaller than 20 nm being 25 mass ppm or more and 220 mass ppm or less, and a difference between a maximum value and a minimum value of the total content of Nb and Ti contained in the precipitate having a particle size of smaller than 20 nm, in a longitudinal direction of the steel sheet, being smaller than 20 mass ppm, $$[\%\ Ti]-(48/14)[\%\ N]-(48/32)[\%\ S]\leq 0 \quad \text{Formula (1):}$$

in Formula (1), [% Ti] represents content (mass %) of component element Ti, [% N] represents content (mass %) of component element N, and [% S] represents content (mass %) of component element S.

2. The high strength steel sheet according to claim 1, having a plating layer on a surface of the steel sheet.

3. A high strength member comprising the high strength steel sheet according to claim 1 subjected to at least either forming or welding.

4. A high strength member comprising the high strength steel sheet according to claim 2 subjected to at least either forming or welding.

5. A method for manufacturing a high strength steel sheet according to claim 1, comprising: a hot rolling process in which a steel slab having the chemical composition is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to a temperature range of 500° C. or higher and 650° C. or lower at an average cooling rate of 10° C./sec or faster, and then coiled in the temperature range; and an annealing process in which the hot rolled steel sheet obtained in the hot rolling process is heated up to an annealing temperature which is $A_{C1}$ transformation temperature or higher and ($A_{C3}$ transformation temperature +20° C.) or lower, held at the annealing temperature for a hold time t (second) that satisfies Formula (3) below, and then cooled:

$$\log\{[\%\ Nb]\times([\%\ C]+12/14[\%\ N])\}\leq 0.75\times(2.4-6700/T) \quad \text{Formula (2):}$$

in Formula (2), T represents heating temperature (° C.) of the steel slab, [% Nb] represents content (mass %) of component element Nb, [% C] represents content (mass %) of component element C, and [% N] represents content (mass %) of component element N; and $$1500\leq(AT+273)\times\log t<3000, \quad \text{Formula (3):}$$

in Formula (3), AT represents annealing temperature (° C.), and t represents hold time (second) at the annealing temperature.

6. A method for manufacturing a high strength steel sheet according to claim 1, comprising: a hot rolling process in which a steel slab having the chemical composition is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to a temperature range of 500° C. or higher and 650° C. or lower at an average cooling rate of 10° C./sec or faster, and then coiled in the temperature range;

a cold rolling process in which the hot rolled steel sheet obtained in the hot rolling process is cold-rolled; and an annealing process in which the cold rolled steel sheet obtained in the cold rolling process is heated up to an annealing temperature which is $A_{C1}$ transformation temperature or higher and ($A_{C3}$ transformation temperature +20° C.) or lower, held at the annealing temperature for a hold time t (second) that satisfies Formula (3) below, and then cooled:

$$\log\{[\%\ Nb]\times([\%\ C]+12/14[\%\ N])\}\leq 0.75\times(2.4-6700/T) \quad \text{Formula (2):}$$

in Formula (2), T represents heating temperature (° C.) of the steel slab, [% Nb] represents content (mass %) of component element Nb, [% C] represents content (mass %) of component element C, and [% N] represents content (mass %) of component element N; and $$1500\leq(AT+273)\times\log t<3000, \quad \text{Formula (3):}$$

in Formula (3), AT represents annealing temperature (° C.), and t represents hold time (second) at the annealing temperature.

7. The method for manufacturing a high strength steel sheet according to claim 5, further comprising a plating process for providing plating, following the annealing process.

8. The method for manufacturing a high strength steel sheet according to claim 6, further comprising a plating process for providing plating, following the annealing process.

9. A method for manufacturing a high strength member, comprising subjecting the high strength steel sheet manufactured by the method for manufacturing a high strength steel sheet according to claim 5, to at least either forming or welding.

10. A method for manufacturing a high strength member, comprising subjecting the high strength steel sheet manufactured by the method for manufacturing a high strength steel sheet according to claim 6, to at least either forming or welding.

11. A method for manufacturing a high strength member, comprising subjecting the high strength steel sheet manufactured by the method for manufacturing a high strength steel sheet according to claim 7, to at least either forming or welding.

12. A method for manufacturing a high strength member, comprising subjecting the high strength steel sheet manufactured by the method for manufacturing a high strength steel sheet according to claim 8, to at least either forming or welding.

13. A high strength steel sheet having a chemical composition in mass % containing:

C: 0.06% or more and 0.14% or less,
Si: 0.1% or more and 1.5% or less,
Mn: 1.4% or more and 2.2% or less,
P: 0.05% or less,
S: 0.0050% or less,
Al: 0.01% or more and 0.20% or less,
Nb: 0.015% or more and 0.060% or less, further containing one of the following (I) to (III);

(I) N: 0.10% or less,
Ti: 0.001% or more and 0.025% or less, and
optionally containing B: 0.0001% or more and less than 0.002%, (II) N: 0.0035% or less,
Ti: 0.001% or more and 0.030% or less, and
optionally containing B: 0.0001% or more and less than 0.002%, and, (III) N: 0.10% or less,
Ti: 0.001% or more and 0.030% or less, and
B: 0.0001% or more and less than 0.002%, optionally containing one or more of following (A) to (B);

(A) one of, or two or more of
Cr: 0.01% or more and 0.15% or less,
Mo: 0.01% or more and less than 0.10%, and
V: 0.001% or more and 0.065% or less, (B) one of or two of,
Cu: 0.001% or more and 0.2% or less, and
Ni: 0.001% or more and 0.1% or less, contents of S, N and Ti satisfying Formula (1) below, a balance being Fe and an inevitable impurity, comprising, in terms of area fraction relative to an entire steel microstructure, 30% or more and 100% or less ferrite, 0% or more and 70% or less martensite, and less than 20% in total of pearlite, bainite and retained austenite, a total content of Nb and Ti contained in a precipitate having a particle size of smaller than 20 nm being 25 mass ppm or more and 220 mass ppm or less, and a difference between a maximum value and a minimum value of the total content of Nb and Ti contained in the precipitate having a particle size of smaller than 20 nm, in a longitudinal direction of the steel sheet, being smaller than 20 mass ppm, $$[\%\ Ti]-(48/14)[\%\ N]-(48/32)[\%\ S]\leq 0 \qquad \text{Formula (1):}$$

in Formula (1), [% Ti] represents content (mass %) of component element Ti, [% N] represents content (mass %) of component element N, and [% S] represents content (mass %) of component element S.

* * * * *